US005353617A

United States Patent [19]

Cherian et al.

[11] Patent Number: 5,353,617

[45] Date of Patent: Oct. 11, 1994

[54] METHOD OF SIZING METAL SLEEVES USING A MAGNETIC FIELD

[75] Inventors: Abraham Cherian, Webster; William Herbert, Williamson, both of N.Y.

[73] Assignee: Xerox Corporation, Stamford, Conn.

[21] Appl. No.: 990,852

[22] Filed: Dec. 14, 1992

[51] Int. Cl.[5] ..... B21D 26/14

[52] U.S. Cl. ..... 72/56; 29/419.2

[58] Field of Search ..... 72/56, 54, 57; 29/419.2

[56] References Cited

U.S. PATENT DOCUMENTS

| | | | |
|---|---|---|---|
| 3,126,937 | 3/1964 | Brower et al. | 72/56 |
| 3,345,732 | 10/1967 | Brower | 72/56 |
| 3,372,566 | 3/1968 | Schenk et al. | 72/56 |
| 3,618,350 | 11/1971 | Larrimer, Jr. | 72/56 |
| 4,619,127 | 10/1986 | Sano et al. | 72/56 |

*Primary Examiner*—David Jones

*Attorney, Agent, or Firm*—Finnegan, Henderson, Farabow, Garrett & Dunner

[57] ABSTRACT

A method of sizing a sleeve of electrically conductive material includes the steps of inserting the sleeve in a die having a seamless inner surface, positioning a magnetic coil inside the sleeve in the die, and sealing the die after the insertion of the sleeve and the positioning of the magnetic coil. A vacuum is created inside the die to avoid air pockets between the outer surface of the sleeve and the inner surface of the die and the magnetic coil is energized to create a magnetic field to expand the sleeve against the inner surface of the die. The process may also be used to form a composite sleeve having an outer layer of material unresponsive to the magnetic field and an inner layer of electrically conductive material.

14 Claims, 2 Drawing Sheets

METHOD OF SIZING METAL SLEEVES USING A MAGNETIC FIELD

BACKGROUND OF THE INVENTION

1. Field of the Invention

The invention relates generally to methods of sizing metal sleeves, and particularly relates to a method of sizing metal sleeves using a magnetic field.

2. Discussion of the Related Art

The process of sizing metal sleeves generally includes expanding the metal sleeve, or at least a portion thereof, to a desired finished shape. Several methods of sizing metal sleeves are known in the art. One known method provides for the insertion of a mandrel into the metal sleeve. An inner surface of the metal sleeve is generally coated with a lubricant and the mandrel contacts the inner surface to expand the metal sleeve to a desired size. Another method, known as hydroforming, uses hydraulic pressure to expand the metal sleeve. Fluid is passed through the metal sleeve and contacts the inner surface. The resulting pressure is controlled to expand the metal sleeve to a desired size.

Another known method of metal forming uses a magnetic field to exert pressure on the sleeve. This method generally requires the use of sleeves composed of electrically conductive material. The conductive sleeves are placed in a split die with a magnetic coil. The magnetic coil generates a magnetic field which induces current in the conductive sleeve, thereby creating an opposing magnetic field. The net magnetic force between the two opposing magnetic fields exerts substantial pressure on the sleeve to expand the sleeve against an inner surface of the die. This process is disclosed in U.S. Pat. No. 2,976,907, which is incorporated herein by reference.

Several applications require the sized metal sleeves to have precise and uniform dimensions, and highly polished outer surfaces. For example, components used in xerographic apparatus, such as photoreceptor substrates, must be uniformly sized and have highly polished outer surfaces to ensure that a toner powder image formed on the photoreceptor substrate is accurately transferred to a copy sheet to clearly depict an image of the original document.

The aforementioned methods cannot consistently produce sized sleeves having uniform dimensions and highly polished outer surfaces. The hydroforming and mandrel methods, which require physical contact with the inner surface of the sleeve, do not consistently produce sized sleeves having precise and uniform dimensions. Additionally, these methods may also damage the inner surface of the sleeve due to the requirement of physical contact. The method of sizing using a split die and magnetic coil can generally produce sized sleeves having more precise and uniform dimensions than those requiring physical contact with the sleeve. However, the outer surfaces of the sized sleeves are not always highly polished since surface deformities caused by the joint of the split die may occur. Additionally, air pockets between the inner surface of the split die and the outer surface of the metal sleeve during the sizing process may cause the metal sleeve to become deformed. As a result, these processes usually require additional machining of the outer surface of the metal sleeve to ensure that the outer surface is precise, uniform, and highly polished.

SUMMARY OF THE INVENTION

Accordingly, it is an object of the present invention to provide a method for sizing a metal sleeve to obtain a precisely formed and dimensioned finished product.

It is another object of the invention to provide a method for sizing a metal sleeve which provides a highly polished outer surface.

It is another object of the present invention to provide a method for sizing a metal sleeve which does not require physical contact with an inner surface of the metal sleeve.

It is a further object of the present invention to provide a method for sizing a metal sleeve which does not require additional machining of the sleeve after sizing.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the method of the invention comprises inserting the sleeve inside a die having a seamless inner surface, positioning an electrical current generating means inside the sleeve in the die, sealing the die after the insertion of the sleeve and the positioning of the current generating means, creating a vacuum inside the die, and generating a current with the current generating means to create a magnetic field which expands the sleeve against the inner surface of the die.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE PREFERRED EMBODIMENT

Reference will now be made in detail to the present preferred embodiment of the invention, which is illustrated in the accompanying drawings.

The method of the present invention may be used to precisely size sleeves composed of an electrically conductive material, such as aluminum and copper. When making photoreceptor substrates, the sleeves are generally composed of aluminum and are cylindrically shaped. However, the sleeves need not be cylindrical and may have bends or contours depending on the application in which the sleeve is to be sized.

Figure 1:
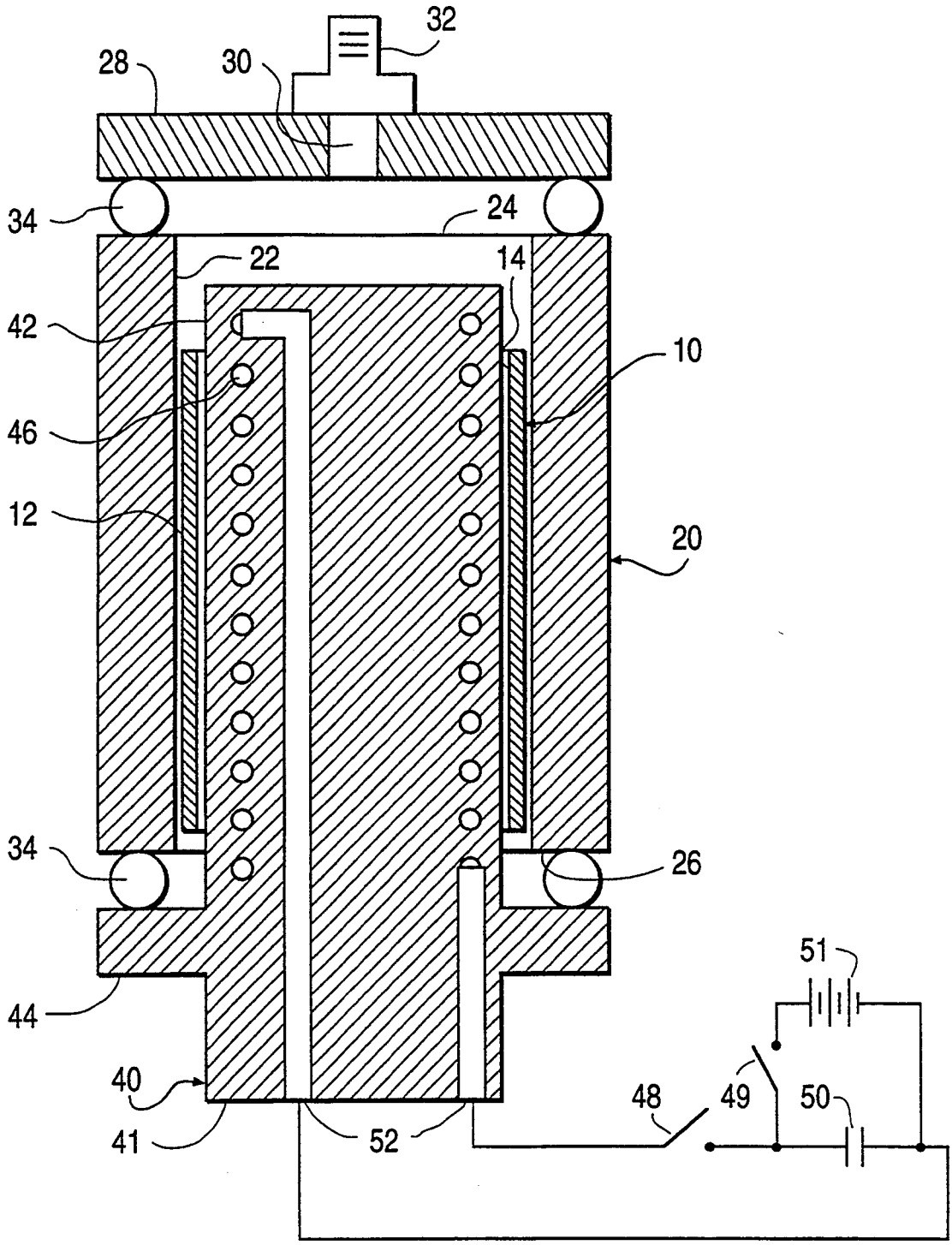
FIG. 1 is a top cross-sectional view of components used in the method of the present invention.

Referring to the FIG. 1, a sleeve 10 is sized in a die 20 which controls the outer dimensions of the sleeve. The die is a cylindrical steel die having a seamless inner circumferential surface 22 . The inner surface 22 of the die is formed to correspond to the desired finished dimensions of the sleeve to be sized. For photoreceptor applications, the steel die is generally cylindrical and the inner surface of the die is highly polished; however, the inner surface of the die may also be knurled or grooved depending on the intended application of the sleeve.

The cylindrical die is opened at each of its ends 24, 26. An end plate 28 sealingly closes end 24 with an 0-ring seal 34. The end plate 28 includes a vacuum port 30 for coupling the inside of the die to a vacuum machine 32. The vacuum machine may be any known type which applies suction to remove air from the sealed die.

The metal sleeve 10 is sized by a magnetic field generated by a magnetic coil 40 assembly. The magnetic coil assembly 40 includes a mandrel 41 having a flanged portion 44 and a generally cylindrical portion 42 having an embedded insulated copper wire 46. The cylindrical portion 42 of the mandrel 41 is formed so that it can be inserted inside the metal sleeve 10 without contacting the metal sleeve's inner surface 14. The flanged portion 44 of the mandrel 41 is formed to close end 26 of the die. An O-ring seal 34 is placed between end 26 of the die and the flanged portion 44 of the mandrel to complete the vacuum seal for the die.

The magnetic coil 40 assembly is energized upon closure of a switch 48. In a typical application, the amount of energy which can be applied to the magnetic coil ranges from 0 to 80 kJ. When switch 49 is closed and switch 48 is open, a high voltage capacitor 50 is charged by voltage supply 51. The capacitor 50 is then discharged by opening switch 49 and closing switch 48 to supply an electric current to coil 46 through lead electrodes 52 which are embedded in the mandrel. The magnetic coil produces extremely intense pulsed magnetic field which induces current in the conductive metal sleeve 10, thereby creating an opposing magnetic field. The net magnetic force generates a uniform pressure which is applied to the inner surface of the metal sleeve to expand the metal sleeve outwardly against the inner surface 22 of the steel die. A magnetic coil suitable for this operation can be purchased from Maxwell Laboratories, Inc. of San Diego, Calif. Furthermore, the structure and operation of the magnetic coil is similar to that disclosed in U.S. Pat. No. 2,976,907, which is incorporated herein by reference.

The method of the present invention is now described with reference to FIG. 1. In the initial step of the process of the present invention, a sleeve 10 of electrically conductive material is inserted into the interior portion of the steel die 20 through one of its ends 26. At this time, the end plate 28 is sealingly mounted on end 24 of the die and the magnetic coil assembly 40 is inserted into the die so that the flanged portion 44 of the magnetic coil is sealed against the opposite end 26 of the die. The magnetic coil assembly is inserted and held coaxially within the sleeve so that the magnetic coil does not physically contact the inner surface 14 of the sleeve.

Once the die is sealed, a vacuum is pulled through port 30. With the evacuation of air, outer surface 12 of the sleeve will not be deformed due to gaps caused by air pockets trapped between the inner surface of the die and the outer surface of the sleeve.

After evacuation, the magnetic coil assembly is energized to expand the metal sleeve against the inner surface 22 of the steel die. The switch 48 is closed to supply a predetermined level of pulsed energy from the previously charged capacitor 48 to the wire coil 46. The magnetic coil assembly generates a pulsed magnetic field which induces current in the electrically conductive sleeve, thereby creating an opposing magnetic field. The net magnetic force generates a radially outward pressure which expands the outer surface 12 of the sleeve against the inner surface 22 of the die within a few microseconds. The magnetic coil assembly is then retracted from inside the die to permit removal of the sized sleeve.

Figure 2:
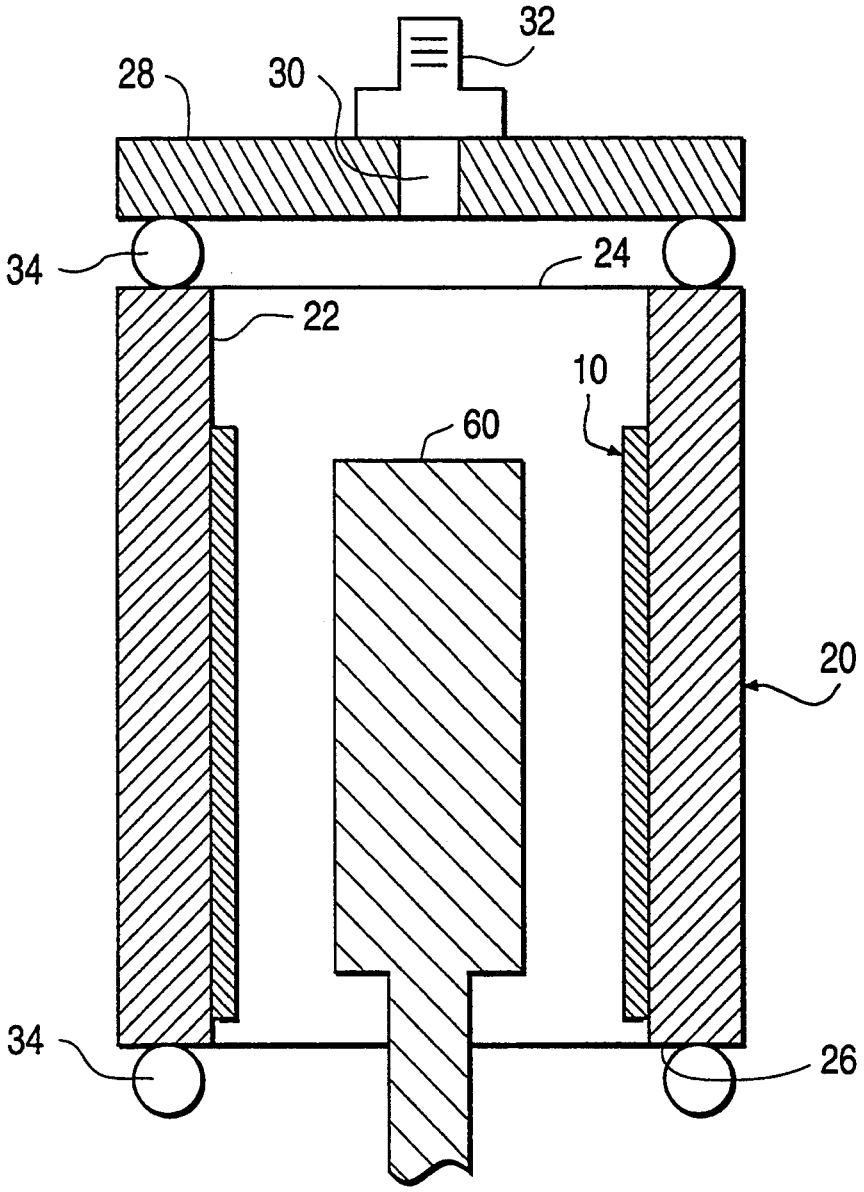
FIG. 2 is a top cross-sectional view of components used in the method of the present invention to cool a sized sleeve.

The final step in the sizing process is the removal of the sized sleeve from the die. When the sleeve is sized, the sleeve will tightly expand against the inner surface of the die. Since a seamless die is used, it is sometimes difficult to remove the sleeve from the die by simply pulling on one end of the sleeve. Therefore, the sleeve is removed from the die by chilling the sleeve and the die so that the sleeve shrinks and more faster than the die. For example, when chilled at the same temperature, aluminum, having a higher thermal coefficient of expansion, will shrink faster and more than steel. Thus, as shown in FIG. 2, an aluminum sleeve can be removed from the steel die by inserting a cooling element 60 inside the die after the magnetic coil 40 is removed. Any well known apparatus for chilling the sleeve and die can be used. For example, a cooling element containing dry ice may be inserted inside the sleeve to accomplish this step.

Other additional steps may also be performed. If an aluminum sleeve is desired to be sized, it is preferable that the aluminum sleeve is first softened prior to the insertion into the die to increase ductility. Heating the aluminum sleeve to approximately 950° F. for at least thirty minutes will soften the aluminum sleeve. The sleeve can then be annealed in a chemical solution after heating to further soften the sleeve. It is also preferable to harden the sized aluminum sleeve after removal from the die by heating the aluminum at 350° F. for approximately 8 hours.

The above process may also be used to size composite sleeves of two or more materials. For example, composite sleeves having layers of different materials may be formed. In fact, a composite sleeve having a core composed of an electrically conductive material can be formed with an outer layer of low conductivity material. In making photoreceptor substrates, it is sometimes desirable to provide a substrate having an inner layer composed of aluminum with a thin outer coating composed of nickel to provide sufficient hardness and a highly polished surface for the photoreceptor substrate. In this process, the abovedescribed steps with regard to sizing sleeves of electrically conductive material are followed with the addition of inserting a sleeve of low conductivity material, such as nickel, into the die and then inserting a sleeve of electrically conductive material, such as aluminum, inside the nickel sleeve. When the magnetic coil generates the magnetic field, the resulting pressure will expand the aluminum sleeve against an inner surface of the nickel sleeve. Although nickel will not respond to the magnetic field, sufficient pressure will be generated by the magnetic coil to drive the aluminum sleeve against the nickel sleeve so that the nickel sleeve is further expanded against the inner surface of the die.

When sizing composite sleeves where nickel or another material of comparable hardness is used, it is not necessary to use a cylinder die having a seamless inner surface. A split die may be used in this application since the nickel coating is hard enough to bridge the die seam.

As a result, the die joint of the split die will not affect the outer surface of the composite sleeve.

The following are examples of specific applications of the process of the present invention:

EXAMPLE 1

A sleeve to be sized is an aluminum sleeve having a length of 310 mm, an inner diameter of 78 mm, and a wall thickness of 2 mm. The die is a cylindrical steel die having an inner diameter of 84 mm inches. The magnetic coil is manufactured by Maxwell Industries, Inc.

In the process of the present invention, the aluminum sleeve is placed inside the steel die and the magnetic coil assembly is positioned within the inner portion of the aluminum sleeve. The magnetic coil assembly charges and discharges a capacitor to supply 4 kJ of energy to the magnetic coil. The magnetic coil assembly expands the aluminum sleeve against the inner surface of the steel die within 80 microseconds. The magnetic coil is then removed from the die and a cooling element containing dry ice is inserted within the inner portion of the aluminum sleeve to chill the aluminum sleeve at a temperature of −78.48° C. Due to differential thermal contraction, the aluminum sleeve shrinks more and faster than the steel die and can be removed within 1 second. As a result, a photoreceptor substrate having an outer diameter of 84 mm and having a highly polished outer surface is formed.

EXAMPLE 2

A composite sleeve to be sized includes an aluminum inner layer and a nickel outer layer. An aluminum sleeve having a length of 310 mm, an inner diameter of 78 mm, and wall thickness of 2 mm, and a nickel sleeve having a length of 310 mm, an inner diameter of 80.1 mm, and a wall thickness of 0.050 mm are used. The die is a cylindrical steel die having an inner diameter of 84 mm. The magnetic coil is manufactured by Maxwell Industries, Inc.

The same process described in Example 1 can be followed to form a photoreceptor substrate having an outer diameter of 84 mm and having a highly polished outer surface.

It will be apparent to those skilled in the art that various modifications and variations can be made in the sizing process of the present invention and in construction of this sizing process without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of sizing a sleeve of electrically conductive material, the sleeve having inner and outer surfaces, comprising the steps of:

inserting the sleeve in a die having a seamless inner surface;

positioning a magnetic field generating means inside the sleeve in the die;

sealing the die after the insertion of the sleeve and the positioning of the magnetic field generating means;

creating a vacuum inside the die to avoid air pockets between the outer surface of the sleeve and the inner surface of the die;

energizing the magnetic field generating means to create a magnetic field to expand the sleeve against the inner surface of the die; and extracting the sized sleeve from the die.

2. The method of claim 1, wherein the extracting step includes cooling the sleeve so that the sleeve contracts more than the die.

3. The method of claim 1, including softening the sleeve prior to the insertion of the sleeve in the die.

4. The method of claim 3, including hardening the sleeve after removing the sleeve from the die.

5. The method of claim 3, wherein the softening step includes heating the sleeve to approximately 950° F. for at least 0.5 hours.

6. The method of claim 4, wherein hardening step includes heating the sleeve to approximately 350° F. for at least 8 hours.

7. The method of claim 1, wherein the die is composed of steel.

8. The method of claim 1, wherein the magnetic field generating means is an electromagnetic coil.

9. The method of claim 8, wherein the electromagnetic coil is a mandrel having an electrical conductor.

10. The method of claim 1, including inserting a second sleeve of material unresponsive to the magnetic field inside the die between the inner surface of the die and the outer surface of the sleeve of electrically conductive material, the second sleeve having an inner surface and an outer surface, wherein the generation of the magnetic field expands the outer surface of the sleeve of electrically conductive material against the inner surface of the second sleeve to expand the second sleeve against the inner surface of the die.

11. A method of sizing a composite sleeve composed of an inner sleeve of electrically conductive material and an outer sleeve of material unresponsive to a magnetic field, comprising the steps of:

inserting the outer sleeve of material unresponsive to a magnetic field inside a die having an inner surface;

inserting the inner sleeve of electrically conductive material into the outer sleeve, the inner sleeve having a smaller diameter than the outer sleeve;

positioning a magnetic field generating means inside the inner sleeve;

sealing the die after the insertion of the sleeves and the positioning of the magnetic field generating means;

creating a vacuum inside the die after the step of sealing the die;

generating a magnetic field with the magnetic field generating means to expand the inner sleeve against an inner surface of the outer sleeve and to further expand the outer sleeve against the inner surface of the die; and extracting the sized composite sleeve from the die.

12. A method of sizing a sleeve of electrically conductive material, the sleeve having inner and outer surfaces, comprising the steps of:

inserting the sleeve in a die having an inner surface;

positioning a magnetic field generating means inside the sleeve in the die;

sealing the die after the insertion of the sleeve and the positioning of the magnetic field generating means;

creating a vacuum inside the die to avoid air pockets between the outer surface of the sleeve and the inner surface of the die;

energizing the magnetic field generating means to create a magnetic field to expand the sleeve against the inner surface of the die; and extracting the sleeve from the die by cooling the sleeve so that the sleeve contracts more than the die.

13. An apparatus for sizing a sleeve of electrically conductive material, the sleeve having inner and outer surfaces, comprising:

a die having a seamless inner surface;

a magnetic field generating means positionable inside the die and positionable inside the sleeve when inserted in the die;

means for creating a vacuum inside the die to avoid air pockets between the outer surface of the sleeve and the inner surface of the die;

means for energizing the magnetic field generating means to create a magnetic field to expand the sleeve against the seamless inner surface of the die; and means for extracting the sized sleeve from the die.

14. The apparatus of claim 13, wherein the means for extracting the sized sleeve from the die includes means for cooling the sleeve so that the sleeve contracts more than the die.

* * * * *